US009259656B2

(12) United States Patent
Gordon

(10) Patent No.: US 9,259,656 B2
(45) Date of Patent: Feb. 16, 2016

(54) INFLATABLE RECREATION DEVICES

(71) Applicant: Donald W. Gordon, Springville, UT (US)

(72) Inventor: Donald W. Gordon, Springville, UT (US)

( * ) Notice: Subject to any disclaimer, the term of this patent is extended or adjusted under 35 U.S.C. 154(b) by 0 days.

(21) Appl. No.: 14/076,168

(22) Filed: Nov. 8, 2013

(65) Prior Publication Data

US 2014/0309046 A1 Oct. 16, 2014

Related U.S. Application Data

(60) Provisional application No. 61/724,162, filed on Nov. 8, 2012.

(51) Int. Cl.

| | |
|---|---|
| ***A63G 13/02*** | (2006.01) |
| ***A63H 33/00*** | (2006.01) |
| ***A63G 23/00*** | (2006.01) |
| ***A63G 29/00*** | (2006.01) |
| ***A63G 31/12*** | (2006.01) |

(52) U.S. Cl.

CPC ..... *A63G 13/02* (2013.01); *A63G 23/00* (2013.01); *A63G 29/00* (2013.01); *A63G 31/12* (2013.01); *A63H 33/00* (2013.01)

(58) Field of Classification Search

CPC ..... A63G 13/02

See application file for complete search history.

(56) References Cited

U.S. PATENT DOCUMENTS

| | | | | |
|---|---|---|---|---|
| 2,813,299 | A | | 12/1957 | Holladay |
| 3,000,022 | A | | 9/1961 | Cathey et al. |
| 3,080,584 | A | | 3/1963 | Brown |
| 3,083,979 | A | | 4/1963 | Boyd |
| 3,125,377 | A | | 3/1964 | Bridges |
| 3,460,828 | A | | 8/1969 | Curlee |
| 3,464,718 | A | | 9/1969 | Fisher |
| 3,537,726 | A | | 11/1970 | Conover |
| 3,664,290 | A | | 5/1972 | Finn |
| 3,779,201 | A | | 12/1973 | Spahn |
| 3,806,156 | A | | 4/1974 | Tidwell |
| 3,905,617 | A | | 9/1975 | Smith |
| 3,934,291 | A | | 1/1976 | Hagen |
| 4,014,540 | A | | 3/1977 | Caulkins |
| 4,042,252 | A | | 8/1977 | Winter |
| 4,154,188 | A | | 5/1979 | Flagg |
| D259,652 | S | | 6/1981 | Ahrens |
| 4,298,197 | A | | 11/1981 | Flagg |
| 4,364,579 | A | | 12/1982 | Fisher |
| 4,401,314 | A | | 8/1983 | Zimmerman |
| 4,458,895 | A | | 7/1984 | Turcotte |
| 4,576,375 | A | | 3/1986 | Roberts |
| 4,729,446 | A | | 3/1988 | Sefton |
| 4,935,970 | A | | 6/1990 | Aristone |
| 5,020,465 | A | * | 6/1991 | Langford ..... 114/345 |
| D335,164 | S | | 4/1993 | Lee |
| D335,165 | S | * | 4/1993 | Lee ..... D21/412 |
| 5,219,309 | A | | 6/1993 | Hart |
| D338,926 | S | | 8/1993 | Welch, Sr. |
| D347,248 | S | | 5/1994 | Franzman |
| 5,570,480 | A | | 11/1996 | Yeung |
| 5,575,738 | A | | 11/1996 | Millington et al. |

(Continued)

*Primary Examiner* — Michael Dennis

(74) *Attorney, Agent, or Firm* — Thorpe North & Western, LLP

(57) ABSTRACT

An inflatable recreation device includes a plurality of inflatable rocking devices joined together end to end to form a walkway for a user to walk along wherein, as the user walks along the walkway, the walkway moves up and down under the user to provide a challenging and entertaining walk which also provides good balancing exercise.

7 Claims, 2 Drawing Sheets

(56) References Cited

U.S. PATENT DOCUMENTS

| | | | | |
|---|---|---|---|---|
| 5,637,057 | A | 6/1997 | Collura | |
| 5,669,858 | A | 9/1997 | Blair et al. | |
| D392,012 | S | 3/1998 | Loiselle et al. | |
| 6,368,226 | B1 | 4/2002 | Gibson | |
| 6,402,627 | B1 | 6/2002 | Gordon | |
| 6,595,861 | B1 | 7/2003 | Morrow et al. | |
| 6,702,686 | B1 | 3/2004 | Brown | |
| 6,709,340 | B2 | 3/2004 | Gordon | |
| 6,786,495 | B1 | 9/2004 | Browning | |
| 6,981,706 | B1 | 1/2006 | Kramer | |
| D520,589 | S | 5/2006 | Peterson | |
| 7,314,399 | B2 | 1/2008 | Turner | |
| 7,682,259 | B1 * | 3/2010 | Edwards | 472/117 |
| 7,722,506 | B2 | 5/2010 | Pratson et al. | |
| 7,833,132 | B2 | 11/2010 | Hylbert et al. | |
| D663,374 | S | 7/2012 | Peterson | |
| 8,460,161 | B2 | 6/2013 | Cole et al. | |
| 8,632,440 | B2 | 1/2014 | Pratson et al. | |
| 2005/0148433 | A1 | 7/2005 | Wang et al. | |

* cited by examiner

INFLATABLE RECREATION DEVICES

PRIORITY CLAIM

Priority is claimed to U.S. Provisional Patent Application Ser. No. 61/724,162 filed Nov. 8, 2012, which is hereby incorporated herein by reference in its entirety.

BACKGROUND

1. Field of the Invention

The invention is in the field of recreation devices which rock up and down similarly to a teeter totter and to recreational devices that provide a walkway for a user to walk along.

2. Related Art

Various inflatable rocking devices which provide up and down action similar to a teeter totter are known, for example as shown my U.S. Pat. No. 6,402,627. Further, devices such as a balance beam providing a narrow walkway for a user to stand on and walk along to perform balancing acts and balancing exercises are known.

SUMMARY OF THE INVENTION

According to the invention, a plurality of inflatable rocking devices are joined together end to end to form a walkway for a user to walk along wherein, as the user walks along the walkway, the walkway moves up and down under the user to provide a challenging and entertaining walk which also provides good balancing exercise. In one embodiment, the device of the invention includes a plurality of inflatable rocking devices each comprising an inflatable central support with an inflatable elongate lever centered on the central support so that the ends of the lever can move up and down in the manner of a teeter totter. The plurality of inflatable rocking devices are arranged on a supporting surface, such as a floor, in a line with adjacent ends of the elongate lever secured together so that the secured together ends move up and down together.

BRIEF DESCRIPTION OF THE DRAWINGS

Additional features and advantages of the invention will be apparent from the detailed description which follows, taken in conjunction with the accompanying drawings, which together illustrate, by way of example, features of particular embodiments of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF ILLUSTRATED EXAMPLE EMBODIMENT

Figure 1:
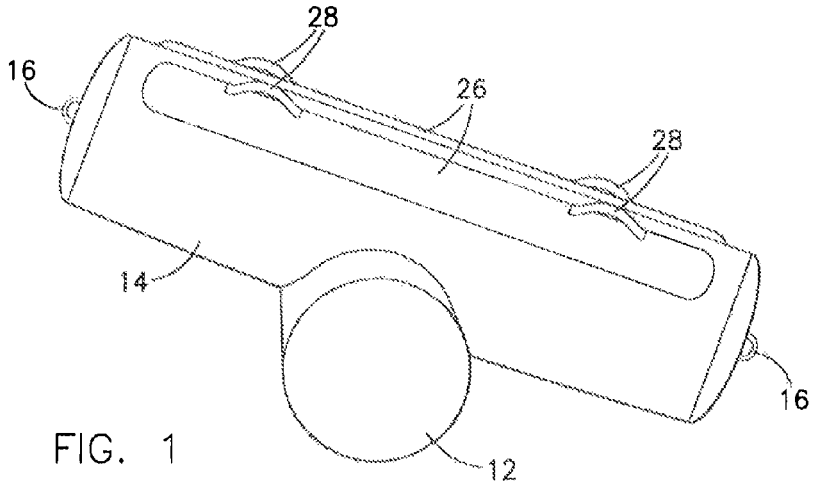
FIG. 1 is a pictorial view of an inflatable rocking device usable as part of the current invention.

FIG. 1 shows a rocking device comprising an inflatable central support 12 with an inflatable elongate lever 14 centered on the top of the central support 12 so that with a user on each end of the of the lever 14, the ends of the lever can alternately move up and down in the manner of a teeter totter. Central support 12, when inflated, forms an elongate tubular support which can rotate on its acruate bottom surface. Lever 14 is centered and secured to the top of tubular support 12 so that it rotates with support 12 as its ends are moved up and down.

Figure 2:
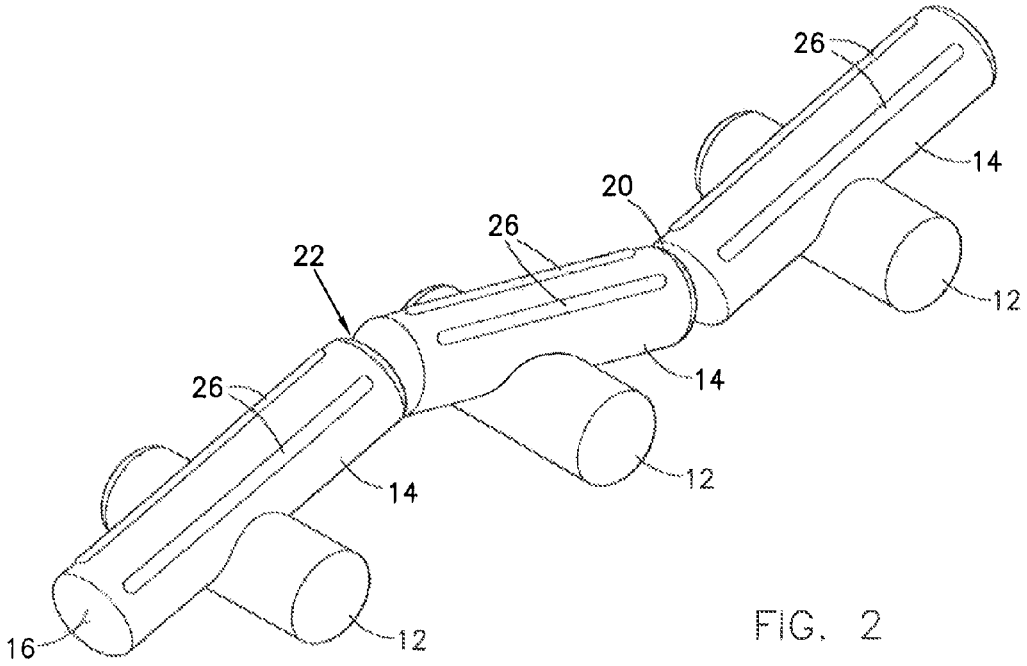
FIG. 2 is a pictorial view of a device of the invention.

The current invention involves connecting a plurality of the rocking devices in end-to-end relationship as shown in FIG. 2. The adjacent ends of the levers 14 can be joined in any suitable manner to allow them to pivot with respect to one another and to move up together and down together, or for one of the adjacent ends to force the other adjacent end to move up when it moves up and to move down when it moves down. In the illustrated embodiment, FIG. 3, each of the ends of each lever 14 is provided with a D ring 16 centered on the end of the lever 14. A connector 18, such as a carabiner or other closable ring type connector connects the adjacent D rings. In this way, the adjacent lever ends are held together and are forced to move up and down together. The levers 14 are generally round when inflated so have a rounded top surface upon which a user of the device can stand and walk. With the present invention, a user can walk along the top of the lever 14 from one end to the other during which the lever 14 will rotate and the ends will move. For example, if the user starts at an end of the lever which is down against the floor as at the left end of FIG. 2, as the user walks up the lever the lever will rotate to a level position when the user is over support 12 and as the user walks further to the right, the lever will move so that the right end moves downwardly. As the user moves to the next lever and walks upwardly toward the support for that lever, the lever will rotate to level position and then the right end will move downwardly as the user walks to the right of the support. However, if several users are walking on the levers, the levers will not rotate in such a predictable manner as the rotation will depend upon the relative weights and positions of the several users along the levers. This makes walking along the levers, i.e., along the walk of the invention, unpredictable and exciting.

Figures 3, 4:
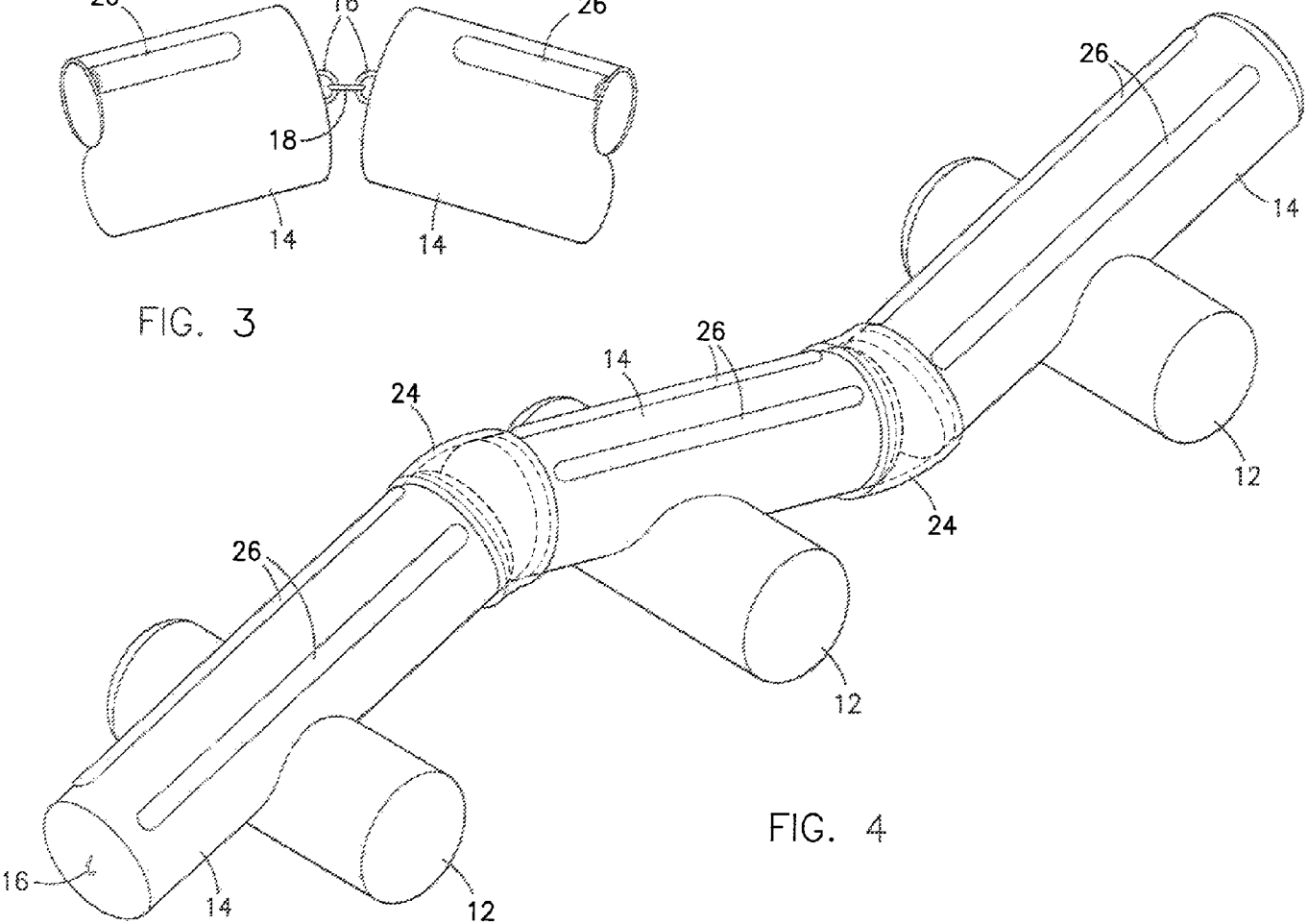
FIG. 3 is a fragmentary side elevation of the ends of two of the inflatable rocking devices of FIG. 1 joined together to form a portion of the device of FIG. 2.
FIG. 4 is a view of the device as shown in FIG. 2 with sleeves extending between respective adjacent ends of the joined rocking devices.

As can be seen in FIG. 2, when the adjacent ends of the levers move up and down, the space between the ends changes from a close space 20 when the ends are down to a wide space 22 when the ends are up. This can be dangerous if a user's foot slips into the space between the ends. Therefore, it is necessary to provide a safety cover extending between adjacent lever ends to prevent a user's foot from entering the space between the adjacent ends or to at least reduce the chances that a user's foot will enter such space. FIG. 4 shows a flexible and somewhat stretchable sleeve or cover 24 extending over the adjacent lever ends which is secured to one end and can slide over the other end to close the space 20 or 22 depending upon the position of the ends. The end of the cover secured to the lever 14 can be secured in various ways, such as with hook and loop fasteners. Various other ways of covering the spaces between lever ends can be used.

If desired, side rails 26 or can be included along the sides of the tops of the levers to provide a wider and more secure walking surface. Handgrips 28, FIG. 1, can also be provided. The lever 14 and central support 12 of each unit can be a single air inflation chamber or the lever 14 and central support 12 can each be formed as separate inflation chambers. Where provided as separate chamber, the support 12 can be partially deflated, if desired, to modify the rotational action of the support. With the ends of the levers connected, a walkway is created which has a wobble action as a user walks along the levers. Various sizes of levers and supports for the rocking devices can be provided and different sizes will react in different ways.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. An inflatable recreation device comprising:

a plurality of inflatable rocking devices, each rocking device comprising a central support and a lever centered on the support and extending in opposite directions from the support to form opposite ends and to form a device wherein the opposite ends alternately move up or down in the manner of a teeter totter, said plurality of such rocking devices being arranged in a line with levers end to end, wherein the lever of each inflatable rocking device has a length between the opposite ends and a top which forms a walking surface along the length of the lever, a pair of side rails extending along at least a portion of the length of the lever to define the walking surface, and a coupling pivotally connecting adjacent lever ends so such connected adjacent ends will move up and down together.

2. An inflatable recreation device according to claim 1, additionally including at least one handle secured to each of the pair of side rails.

3. An inflatable recreation device according to claim 2, wherein the walking surface is convex.

4. An inflatable recreation device according to claim 1, additionally including a cover extending between each of the connected adjacent lever ends.

5. An inflatable recreation device according to claim 1, wherein the coupling includes a D ring centered with respect to and secured to each adjacent lever end and a connecting device connecting the D rings of adjacent lever ends.

6. An inflatable recreation device according to claim 1, wherein the walking surface is convex.

7. An inflatable recreation device according to claim 1, wherein the lever arm is circular in cross section.

* * * * *